United States Patent [19]

Chabinsky et al.

[11] 4,378,489

[45] Mar. 29, 1983

[54] MINIATURE THIN FILM INFRARED CALIBRATION SOURCE

[75] Inventors: Douglas J. Chabinsky; Roger C. Coda, both of Harvard, Mass.

[73] Assignee: Honeywell Inc., Minneapolis, Minn.

[21] Appl. No.: 264,921

[22] Filed: May 18, 1981

[51] Int. Cl.[3] ..... H05B 3/16

[52] U.S. Cl. ..... 219/543; 219/209; 250/493.1; 338/309

[58] Field of Search ..... 219/209, 210, 216, 543, 219/354; 338/308, 309; 250/336, 363 S, 252, 493, 494, 495

[56] References Cited

U.S. PATENT DOCUMENTS

| | | | |
|---|---|---|---|
| 3,887,785 | 6/1975 | Ahlport | 219/209 |
| 3,961,155 | 6/1976 | Weldon et al. | 219/216 |
| 4,078,178 | 3/1978 | Lowes | 250/252 X |
| 4,099,046 | 7/1978 | Boynton et al. | 219/543 X |
| 4,256,960 | 3/1981 | Snider | 250/252 |

*Primary Examiner*—Volodymyr Y. Mayewsky
*Attorney, Agent, or Firm*—John S. Solakian; Laurence J. Marhoefer

[57] ABSTRACT

An evaporated thin-film platinum resistance thermometer interleaved with a nichrome heating element on a sapphire substrate so as to calibrate infrared detectors and allow accurate control of the output signals of such detectors.

11 Claims, 7 Drawing Figures

MINIATURE THIN FILM INFRARED CALIBRATION SOURCE

BACKGROUND OF THE INVENTION

The Government has rights in this invention pursuant to Contract No. DASG-60-78-C-0141 awarded by the Department of the Army.

The present invention relates generally to infrared devices and more particularly to devices for monitoring and regulating the temperature of an infrared device.

In infrared sensors which utilize focal plane detector arrays, it is often desirable to have a fast response gray-body photon source near the detector array in order to calibrate and test the infrared detector array performance prior to data collection. In the past, this photon source (irradiator) has consisted of a thin-film nichrome heating element evaporated on a sapphire substrate, connected to a suitable current source through gold wires and gold pads evaporated on the sapphire surface. A potential applied across the nichrome element causes it to heat. This energy is dissipated primarily through radiation by the nichrome element and the sapphire substrate, which is a good heat conductor, particularly at the cryogenic temperatures (e.g., 77 degrees Kelvin) these systems operate at.

The primary disadvantage of these prior devices is that they must be calibrated empirically, i.e., the voltage required to generate a desired device temperature must be determined by trial and error measurement. A further disadvantage of such devices is that this empirically determined relationship may change throughout the lifetime of the devices, as the thermal characteristics of the constituent materials, for example the nichrome heating element, degrade. An additional disadvantage of this device is its susceptibility to electronic drift.

It is accordingly a primary object of the present invention to provide an improved apparatus for accurate control of the output signals of infrared detectors.

SUMMARY OF THE INVENTION

The above and other objects of the present invention are achieved by providing an infrared source near a detector array in order to calibrate and test the detector array performance prior to data collection. A resistance thermometer is interleaved with a heating element on a base therefor. In a preferred embodiment the thermometer is made of thin-film platinum, the heating element is made from nichrome, and the base is a sapphire material. The temperature emitted from the sapphire substrate is monitored and calibrated by varying the voltage of the nichrome heating element as a function of the temperature measured by the thermometer.

BRIEF DESCRIPTION OF THE DRAWINGS

The above and other objects of the present invention are achieved in the illustrative embodiment as described with respect to the Figures in which.

DETAILED DESCRIPTION OF THE PREFERRED EMBODIMENTS

Figure 1A:
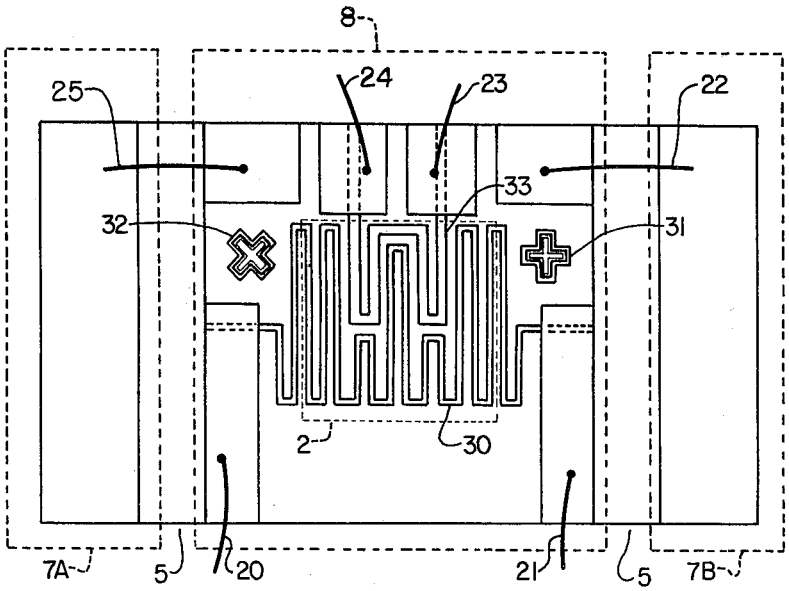
FIGS. 1A and 1B show schematic top and sectional views respectively of the subject invention.
Figure 1B:
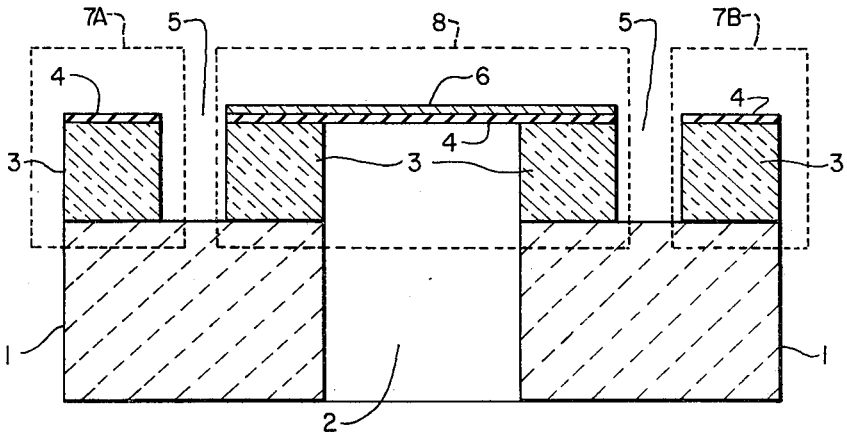

Referring to FIGS. 1A and 1B, the device of the present invention includes a platinum sensing element 33 and a nichrome heating element 30. The temperature to which the device is raised depends on the amount and the duration of current through the nichrome element. This current is controlled by an electronic servo loop which uses the platinum sensor as a feedback device. Platinum is used because of its high resistivity temperature coefficient. Nichrome is used for the heating element because of its very low resistivity temperature coefficient. Both of these factors make possible the electronic control of the temperature of the calibrator and help in simplifying the control design.

The material sizes of such elements 30 and 33 are selected based on the requirements which must be satisfied. These requirements include: (i) the power required to attain the desired temperature; (ii) the rise and decay time to and from the desired temperature; (iii) the time duration at the desired temperature; and (iv) the emitter 4 area. The area of the sapphire emitter 4 is determined in part by the required emitting area and also in part by the physical area required to apply the heater 30 and temperature sensor 33. The sapphire substrate 4 thickness is selected based on the rise and decay times, the power available and the size, material and fabrication techniques therefore. The epoxy 3 thickness is selected to give the desired thermal resistance between the sapphire emitter 4 and the heat sinks 7A and 7B which include substrates 1 and 4. This thermal resistance is chosen to give the desired results and meet the requirements specified. The alumina thickness is made large enough to achieve a small thermal resistance within itself and to the final heat sink.

The design of the nichrome heating element is governed by the same criteria as for the platinum. One other consideration is the amount of power required to drive the device to the required temperature levels. For use in a given system, the values of both the platinum and nichrome may be chosen on the basis of the system operating temperature and available voltage supplies in the system. In one embodiment, and by way of example, the calibrator is pulsed with a 50 millisecond wide pulse with a maximum required current of about 60 milliamperes. If the maximum available supply voltage is 12 volts, this then requires the nichrome resistance to be about 200 ohms. The platinum resistance is chosen to be about 2,000 ohms at the sensor operating temperature (e.g., 300 degrees Kelvin). However, this value of platinum resistance could have been chosen anywhere between 1,000 ohms and 10,000 ohms. With the above-noted electrical parameters it has been found that the device of the present invention can operate in a temperature range of 10 degrees Kelvin to 400 degrees Kelvin.

The value of electrical resistance chosen is dependent upon the operating temperature range, the electronic control circuit and the desired controlability. Upon selection of a resistance value for the platinum element, one can relate this to the physical geometry through the following expression:

$$R = P\,L/[(T)(W)];$$

where

R = electrical resistance in ohms;

P = electrical resistivity of platinum in ohm-cm;

L=length of the evaporated platinum strip in cm;
T=thickness of the evaporated platinum strip in cm; and
W=width of the evaporated platinum strip in cm.

With R given as the desired resistance and the resistivity known (property of platinum), the dimension can be adjusted to give the desired ratio of (L) divided by the product of (T) times (W) to achieve the desired resistance. The same formula may be used to determine the resistance and physical geometry of the nichrome element.

The following is a description of the fabrication of the infrared calibrator of the present invention. The values given are by way of example only for one embodiment of a calibrator in accordance with the principles of the present invention.

A thin (approximately 0.020 inches) alumina substrate 1 is drilled with a hole 2 which forms the centered shaft of the calibration device and which provides thermal isolation. The hole covers the area of the elements 30 and 33 and, in the embodiment shown, is a square hole. A suitable wax or other blocking material is extruded through the hole 2 to extend above the surface of the alumina substrate 1. The area around the wax column is filled with an epoxy 3 to the height of the column. This epoxy 3, ground to a thickness of 0.010 inches, forms the bonding surface for the sapphire substrate 4.

A thin (0.0005 to 0.001 inches) layer of mono-crystalline sapphire 4, which will become the emitter of the device, is adhered to the epoxy surface 3. While sapphire has excellent heat conducting properties, other materials might be substituted, for example, diamond. The sapphire surface is then cleaned using an ion beam milling technique.

Figure 3A:
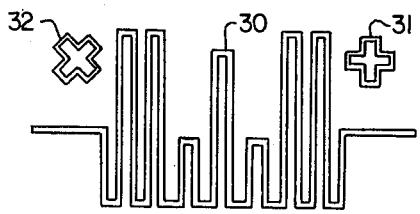
FIGS. 3A, 3B and 3C show the photo resist masks used to evaporate deposit nichrome, platinum and gold patterns, respectively.

The patterned thicknesses of nichrome, platinum and gold are successively applied to the sapphire substrate 4 using standard evaporation deposition and photoresist techniques. FIG. 3A shows the pattern of the nichrome heating element 30 applied to the surface. In one embodiment, approximately 2,900 angstroms of nichrome are applied in the pattern over a base of 30 angstroms of chrome, which acts as a bonding agent between the sapphire and the nichrome. Cross patterns 31 and 32 are used as alignment guides for the application of successive masks and patterns.

Figure 3B:
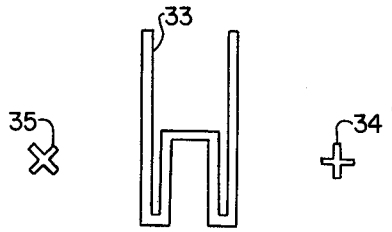

FIG. 3B shows the mask pattern for the platinum thermometer 33. Patterns 34 and 35 are the alignment marks, which overlay cross patterns 31 and 32 respectively, to ensure that the mask is properly positioned. Approximately 30 angstroms of chrome, followed by approximately 900 angstroms of platinum, are applied to the sapphire substrate using this mask. The pattern of the heating element 30 and the thermometer element 33 are interleaved as shown in FIG. 1A to insure an even heat distribution and temperature measurement across the pattern surface 6.

Figure 3C:
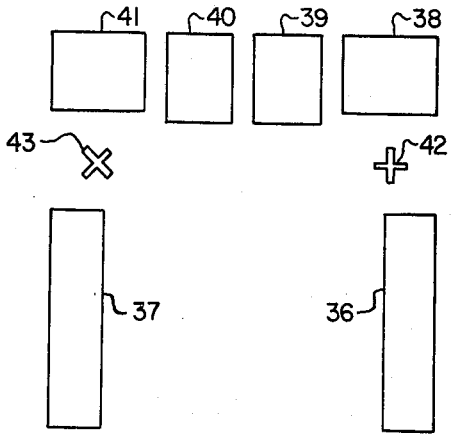

FIG. 3C shows the mask for gold pads 36 through 41 which are vapor deposited over the nichrome and platinum elements to form an electrical contact surface to which wire bonds can be made. Cross patterns 42 and 43 overlay patterns 34 and 35 to properly align the masking for the pads.

A diamond saw is used to cut slots 5 approximately 0.010 inches deep around the pattern surface 6 to the top surface of the alumina 1 as shown in FIG. 1B. These slots provide further thermal isolation of the section containing the calibrator 8 and isolate calibration device 8 from heat sink blocks 7A and 7B.

Gold leads 20 through 25, which in one embodiment are 0.001 inches thick, are applied to the gold terminal pads by thermal compression bonding. Leads 20 and 21 connect to opposite ends of the heater element 30; leads 23 and 24 connect to opposite ends of the thin-film platinum thermometer 33; and leads 22 and 25 act as a thermal conduit connecting the device 8 to the heat sink blocks 7A and 7B. The width of leads 22 and 25 may be selected depending upon the thermal conductivity desired.

Figure 2A:
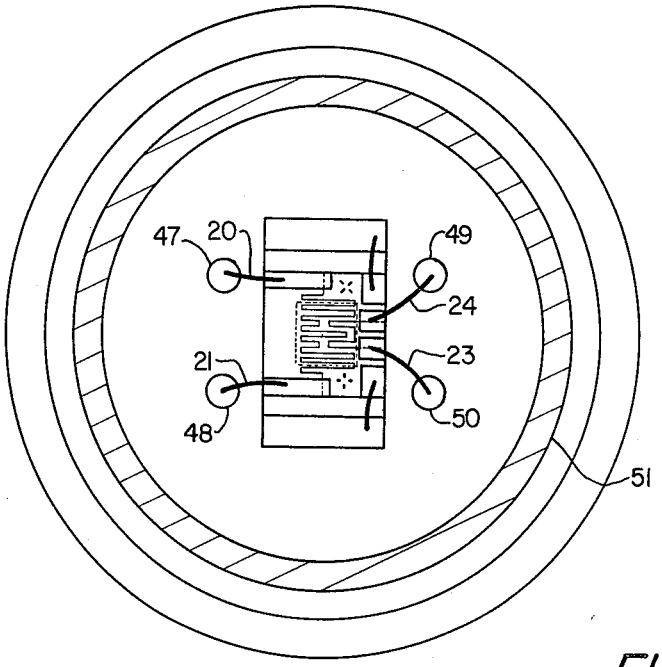
FIGS. 2A and 2B show top and sectional views respectively of the invention in place in a calibration system.
Figure 2B:
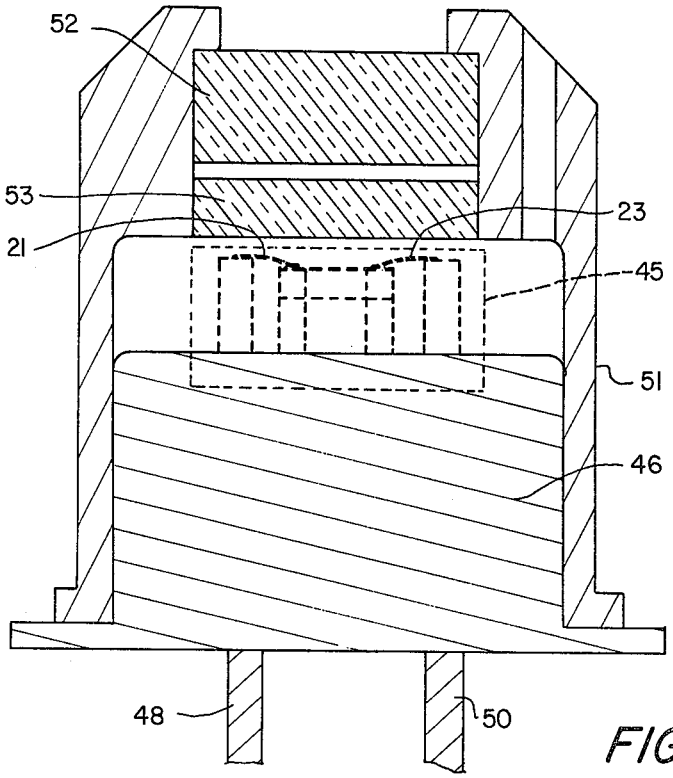

The completed device 45; i.e., the device of FIGS. 1A and 1B, is mounted in a header 46 as shown in FIG. 2A. Gold leads 20, 21, 23 and 24 are soldered to pins 47, 48, 49 and 50 of the header, respectively. An aluminum cover 51 is applied to protect the device. A spectral filter 52 and neutral density filter 53 are included to select a waveband and to attenuate the output of the device.

The calibrator 8 may be thermally pulsed. Preferably, the device is pulsed just prior to data collection, thereby assuring correct calibration for use of the associated detector array. In one embodiment, and by way of example, a current of 60 milliamperes is applied to the nichrome element for 50 milliseconds. Under the input power, the device 8 rises from 10 degrees Kelvin to 400 degrees Kelvin in approximately 10 milliseconds, remains constant for an additional 40 milliseconds and then decays to 10 degrees Kelvin in 50 milliseconds or less. Data collection is then made by use of the detector array.

Having described the invention, what is claimed as new and novel and for which it is desired to secure Letters Patent is:

1. In an infrared system having one or more infrared detectors, a device for calibrating said detectors prior to use of said detectors for data collection, said device comprising:

A. a first substrate;
B. a second substrate having good heat conduction properties;
C. means for bonding a thin layer of said second substrate to said first substrate;
D. a heating element having a substantially constant electrical resistance property over the desired operating temperature range of said device;
E. a temperature sensing element having a high change in electrical resistance over the operating temperature range of said device;
F. means for applying said heating element and said temperature sensing element to a common area of said thin layer of said second substrate on a side of said thin layer opposite said first substrate; and
G. means for providing thermal isolation between said common area of said thin layer of said second substrate and said first substrate.

2. A device as in claim 1 wherein said heating element and said sensing element include a length, width and thickness which are selected based upon, in part, the time to increase from an initial temperature to a desired temperature of said device, the time duration at said desired temperature, and the time to return from said desired temperature to said initial temperature.

3. A device as in claim 2 wherein said heating element and said sensing element are interleaved over a portion of said common area.

4. A device as in claim 2 wherein said time duration at said desired temperature is in the order of milliseconds and wherein said time duration and accordingly the calibration of said detectors is performed immediately prior to the use of said detectors.

5. A device as in claim 2 wherein said means for providing thermal isolation includes a hole through said first substrate and said means for bonding in a location below said common area.

6. A device as in claim 5 wherein said means for providing thermal isolation further includes two slots cut through said second substrate and said means for bonding on two opposite sides of said common area, each of said slots separating said common area from first and second heat sinks respectively, each of said heat sinks comprising said first substrate and said second substrate.

7. A device as in claim 6 further comprising first and second conductive strips coupled between said common area and said first and second heat sinks respectively, wherein the cross-sectional area of said strips is selected based upon the temperature desired for said device and the configuration and volume of said device.

8. A device as in claim 2 wherein said second substrate may be made from a substance such as sapphire or diamond.

9. A device as in claim 2 wherein said heating element is made from a substance such as nichrome and wherein said sensing element is made from a substance such as platinum.

10. A device as in claim 2 wherein said means for bonding is an epoxy.

11. A device as in claim 2 wherein the resistance of said heating element is in the range of one hundred to five hundred ohms and wherein the resistance of said sensing element is in the range of one thousand to ten thousand ohms.

* * * * *